US010738774B2

(12) United States Patent
Kim et al.

(10) Patent No.: US 10,738,774 B2
(45) Date of Patent: Aug. 11, 2020

(54) RECIPROCATING TYPE COMPRESSOR

(71) Applicant: LG ELECTRONICS INC., Seoul (KR)

(72) Inventors: Seungwook Kim, Seoul (KR); Ki Yeon Lee, Seoul (KR); Jongmok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/136,382

(22) Filed: Sep. 20, 2018

(65) Prior Publication Data

US 2019/0093650 A1 Mar. 28, 2019

(30) Foreign Application Priority Data

Sep. 28, 2017 (KR) ..... 10-2017-0126601

(51) Int. Cl.

| | |
|---|---|
| ***F04B 39/12*** | (2006.01) |
| ***F04B 37/12*** | (2006.01) |
| ***F04B 39/00*** | (2006.01) |
| ***F04B 39/10*** | (2006.01) |

(52) U.S. Cl.

CPC ..... *F04B 39/127* (2013.01); *F04B 37/12* (2013.01); *F04B 39/0044* (2013.01); *F04B 39/10* (2013.01); *F04B 39/121* (2013.01); *F04B 39/125* (2013.01)

(58) Field of Classification Search

CPC ..... F04B 39/125; F04B 39/126; F04B 39/127
See application file for complete search history.

(56) References Cited

U.S. PATENT DOCUMENTS

| | | | | |
|---|---|---|---|---|
| 3,465,954 A * | 9/1969 | Ellis | F25B 31/02 417/363 |
| 4,273,519 A * | 6/1981 | Gannaway | F04B 39/121 417/273 |
| 2003/0021704 A1* | 1/2003 | Christiansen | F04B 37/14 417/315 |

FOREIGN PATENT DOCUMENTS

| | | |
|---|---|---|
| DE | 968 020 | 1/1958 |
| DE | 10 2008 024 670 | 11/2009 |
| FR | 2 161 727 | 7/1973 |
| JP | 2006-161802 | 6/2006 |
| JP | 2015-140737 | 8/2015 |
| KR | 1986-0004243 | 6/1986 |
| KR | 10-2005-0027221 | 3/2005 |
| KR | 10-0559083 | 3/2006 |
| KR | 10-2008-0050729 | 6/2008 |
| KR | 10-1745471 | 6/2017 |
| WO | WO 98/49447 | 11/1998 |

OTHER PUBLICATIONS

European Search Report issued in Application No. 18196063.4-1004 dated Mar. 6, 2019.
International Search Report dated Jan. 9, 2019.
Korean Notice of Allowance dated Feb. 26, 2019.

* cited by examiner

*Primary Examiner* — F Daniel Lopez
(74) *Attorney, Agent, or Firm* — Ked & Associates LLP

(57) ABSTRACT

A reciprocating type compressor having a structure in which a rotational support of a rotational shaft and a cylinder are manufactured as separate components; a frame provided with the rotational support fixes the cylinder; and a cylinder head is fixed to the frame to cover the cylinder.

20 Claims, 8 Drawing Sheets

RECIPROCATING TYPE COMPRESSOR

CROSS-REFERENCE TO RELATED APPLICATION(S)

This application claims priority under 35 U.S.C. § 119 to Korean Application No. 10-2017-0126601, filed in Korea on Sep. 28, 2017, whose entire disclosure is herein incorporated by reference.

BACKGROUND

1. Field

A reciprocating type compressor is disclosed herein.

2. Background

A compressor is an apparatus to increase pressure by compressing gas. The compressor is categorized into a reciprocating type compressor in which gas suctioned into a cylinder is compressed and discharged by a piston, and a scroll type compressor in which gas is compressed by rotating two scrolls relative to each other, based on how gas is compressed.

Referring to FIGS. 1 and 2, a reciprocating type compressor 1 is based on a principle that a piston 40 that reciprocates in a direction of a second axis 92 compresses fluid introduced into a bore of a cylinder 30. In the reciprocating type compressor, as the piston 40 continuously reciprocates in the bore of the cylinder 30, shapes and dimensional accuracy of an inner diameter of the bore and an outer diameter of the piston 40 greatly affect efficiency of the compressor.

A cylinder head 70 is coupled to an end of the cylinder 40. A cylinder with a block shape is provided with a tapped nut hole 31, and a portion of the cylinder head 70 corresponding to the nut hole 31 is provided with a through hole 71. The cylinder head 70 is fixed to the cylinder 30 by fastening a fastening bolt 80 to the nut hole 31 through the through hole 71

However, deformation of the cylinder and the bore of the cylinder is caused by the process of fastening the fastening bolt 80 to the nut hole 31. Such deformation in an assembling process is not only difficult to predict but also is very difficult to control quantitatively. Therefore, even though the bore of the cylinder is precisely processed, a gap between the bore and the piston is changed from a designed dimension after the bore is deformed in the assembling process.

In particular, when the gap between the piston and the bore of the cylinder is narrower than the designed dimension due to the deformed shape, an oil film of the lubricating oil is broken, and accordingly, the piston and the bore of the cylinder are in direct contact with each other, resulting in deterioration in wear reliability of the piston and the bore of the cylinder.

In view of this point, it is possible to prevent the oil film of the gap from being broken by making the gap between the piston and the bore of the cylinder a little wider, thereby ensuring the wear reliability even when the piston and the bore of the cylinder are deformed in the assembling process of the compressor. But, the widened gap may not maintain fluid-tightness, resulting in a reduction in compression efficiency.

In the reciprocating type compressor, a rotational shaft 50 rotates with respect to a first axis 91, and a crank pin 51 is eccentric with respect to the first axis 91 and is provided on the rotational shaft 50. Hence, when the rotational shaft 5 rotates, the crank pin 51 circles around the first axis 91. Opposite ends of a connecting rod 46 are rotatably coupled to the piston 40 and the crank pin 51, respectively, so that the piston 40 reciprocates in the bore of the cylinder 30 as the rotational shaft 50 rotates. The first axis 91 and the second axis 92 are orthogonal to each other.

According to the above-described structure, alignment of the first axis 91 and the second axis 92 is very important in order to ensure reliability of the compressor. In view of this point, the cylinder 30 and a rotational supporting portion or support 25 of the rotational shaft 50 have been manufactured as a single component in the conventional art. For this purpose, the cylinder and the rotational supporting portion are generally manufactured by casting. However, such a structure results in an increase in manufacturing costs and a weight of the compressor.

In addition, as the cylinder and the rotational supporting portion are integrally manufactured by casting, all the points to support the rotational shaft exist below the second axis 92. Thus, it is difficult to firmly support the rotational shaft, and it is required to increase a vertical length of the rotational supporting portion so as to enhance a support reliability of the rotational shaft. Accordingly, a size of the compressor inevitably becomes larger.

BRIEF DESCRIPTION OF THE DRAWINGS

Embodiments will be described in detail with reference to the following drawings in which like reference numerals refer to like elements, and wherein.

DETAILED DESCRIPTION

Figure 1:
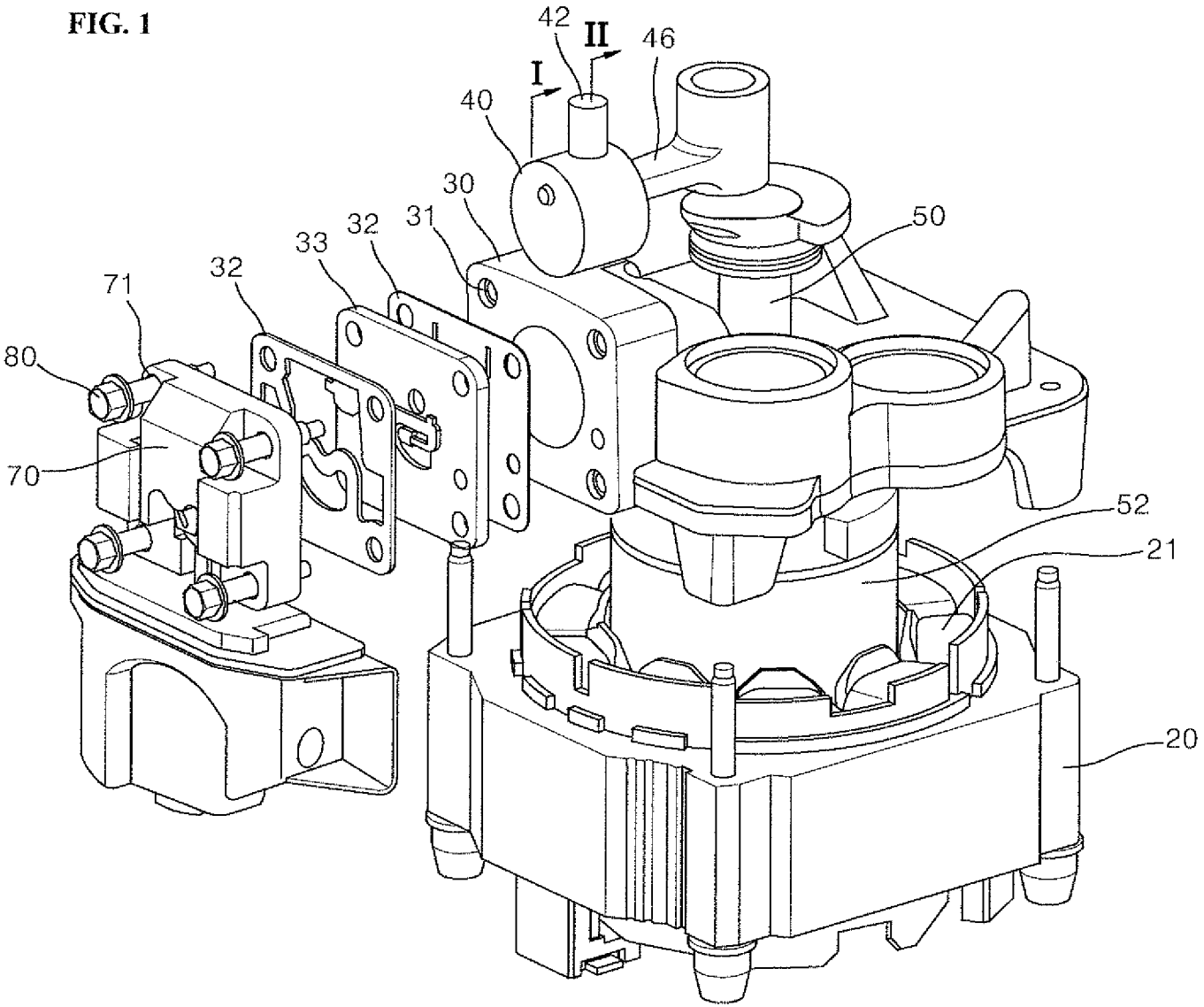
FIG. 1 is an exploded perspective view showing internal components elements of a reciprocating type compressor.

Hereinafter, embodiments will be described with reference to the accompanying drawings. Where possible, the same or similar reference numerals have been used to indicate the same or similar elements and repetitive disclosure has been omitted.

Embodiments are not limited to the embodiments disclosed herein but may be implemented in various different forms. The embodiments are provided to make the description thorough and to fully convey the scope to those skilled in the art.

A structure and operation principle of a reciprocating type compressor according to embodiments will be described with reference to FIGS. 3 to 8.

For ease of explanation, a longitudinal direction of a rotational shaft 50 may be referred to as a vertical direction, a direction in which the bore of cylinder 30 is seen may be referred to as "front", an opposite direction thereof may be referred as "rear", and bilateral directions of the cylinder may be referred to as "lateral".

Figure 7:
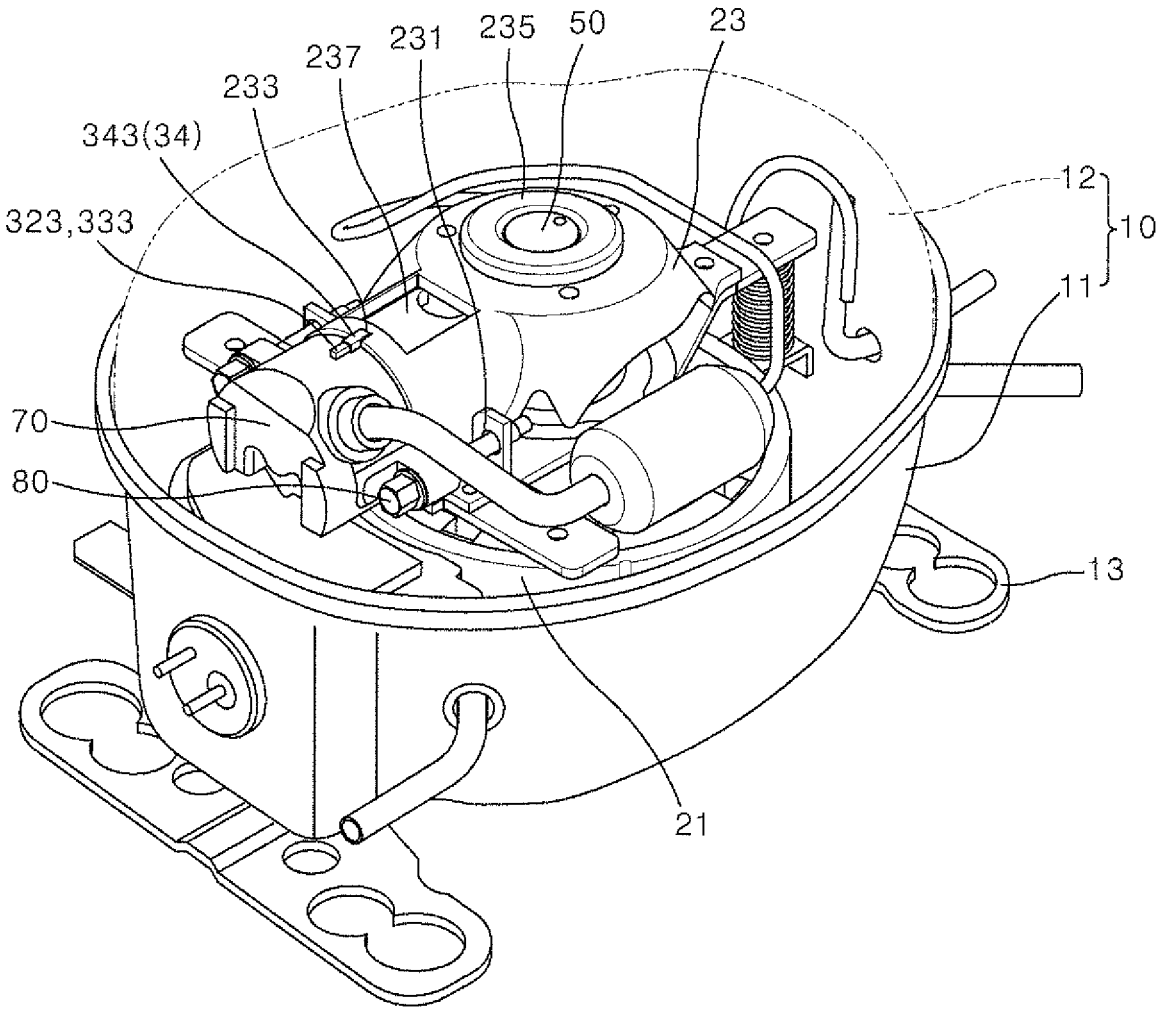
FIG. 7 is a perspective view of the compressor of FIG. 3.
Figure 8:
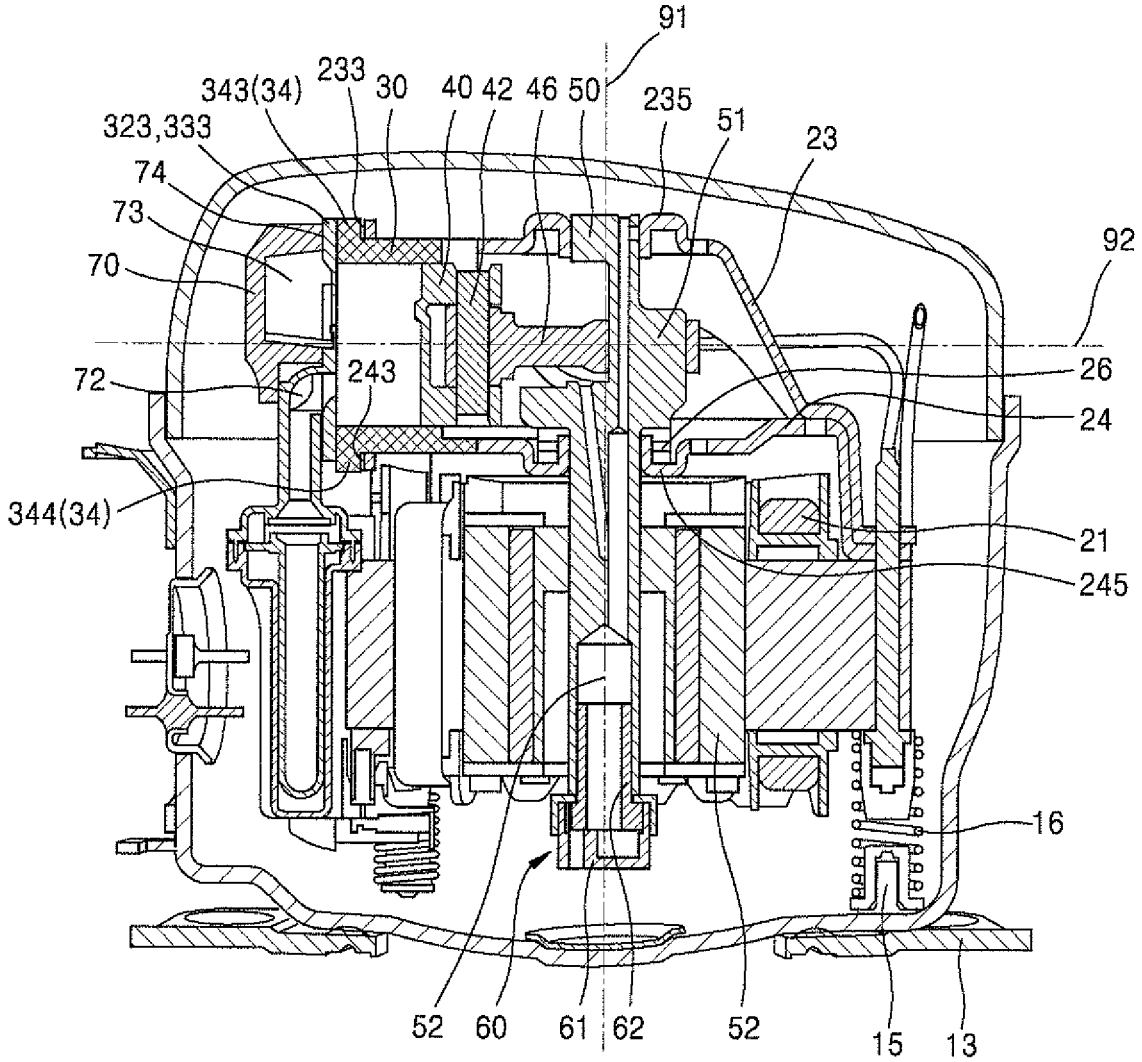
FIG. 8 is a side sectional view of the compressor of FIG. 7.

Each component of compressor 1 may be installed in a housing 10. Referring to FIGS. 7 and 8, the housing 10 may include a main housing 11 with a shape of a deep container, and a cover housing or cover 12 to cover and seal an upper portion of the main housing 11. A leg 13 may be provided at a lower portion of the main housing 11. The leg 13 may be configured to fix the compressor 1 to an installation location.

A boss 15 may be provided at a bottom of an inner space of the housing 10. The boss 15 may fix an elastic device 16 such as, for example, a coil spring. An internal component of the compressor may be fixed to an upper portion of the elastic device 16. The elastic device 16 may fix the internal component of the compressor to the housing 10 while preventing the housing 10 and the internal component of the compressor from being directly connected to the housing. Therefore, the elastic device 16 may prevent vibration of the internal component of the compressor from being transferred to the housing 10.

The internal component of the compressor may be fixed or supported by an upper frame 23 and a lower frame 24. The upper frame 23 and the lower frame 24 may be provided with an upper rotational supporting portion or support 235 and a lower rotational supporting portion or support 245 to support the rotational shaft 50, respectively. The two rotational supporting portions 235 and 245 may be aligned with each other along the first axis 91 (see FIG. 8). The two rotational supporting portions 235 and 245 may be provided with a bearing 26, and the rotational shaft 50 may be rotatably supported on the frames 23 and 24 by the bearing 26.

The rotational shaft 50 may extend in the vertical direction, and may be rotatably supported by the frames 23 and 24 at two upper and lower points with the crank pin 51 positioned therebetween. In the conventional compressor shown in FIGS. 1 and 2, the rotational shaft 50 may be supported at two points of a lower portion of the crank pin 51. On the other hand, the compressor according to the embodiments shown in FIGS. 3 to 8 may have a structure in which the rotational shaft is supported at two points which respectively correspond to upper and lower portions of the crank pin 51.

The rotational shaft 50 may rotate in a motor driving manner, and may be inverter-controlled. A stator 21 may be fixed to a lower portion of the lower frame 24. A rotor 52 may be fixed to the rotational shaft 50. A rotational force may be generated in the rotor 52 by inverter control, and accordingly, the rotational shaft 50 may rotate.

In one embodiment, an inner rotor structure in which the rotor 52 is surrounded by the stator 21 is exemplified, but an outer rotor structure also may be applied. When the outer rotor structure is applied, a torque of the rotational shaft generated by the rotor may increase, thereby reducing a length of the rotational shaft to that extent.

The rotational shaft 50 may extend in the vertical direction. That is, the rotational shaft 50 may be disposed in the vertical direction. The rotational shaft 50 may rotate with respect to first axis 91 which is a vertical axis.

An upper portion of the rotational shaft 50 may be provided with crank pin 51. The crank pin 51 may extend parallel with the first axis 91. The crank pin 51 may be located eccentrically from a center of the rotational shaft 50. Therefore, when the rotational shaft 50 rotates with respect to the first axis 91, the crank pin 51 may revolve around the first axis 91. A counterweight may be provided at a location that faces an eccentric location of the crank pin 51 with respect to the first axis 91, so as to prevent vibration of the rotational shaft 50.

The cylinder 30 that extends in a horizontal direction may be provided at a height corresponding to that of the crank pin 51. For reference, the cylinder 30 of the compressor shown in FIGS. 1 and 2 may be constructed integrally with the rotational supporting portion 25. On the other hand, in the compressor according to embodiments, the cylinder 30 may be constructed as a separate component from the rotational supporting portion 25. That is, the cylinder 30 may constitute one component, and the frames 23 and 24 provided with the rotational supporting portions 235 and 245 may constitute other components. Then, the components may be mutually assembled so that the cylinder 30 and the rotational supporting portions 235 and 245 are mutually aligned.

A bore of the cylinder 30 may be arranged in a direction of second axis 92 that intersects perpendicularly to the first axis 91 which is the center of the rotational shaft 50. That is, the bore of the cylinder 30 may be arranged horizontally. The cylinder 30 may be spaced apart from the first axis 91 by a predetermined distance in a radial direction of the first axis.

Piston 40, which reciprocates along a longitudinal direction of the bore, that is, a horizontal direction, may be inserted into the bore of the cylinder 30. A motional direction of the piston 40 may correspond to a direction of the second axis 92, and a center O of the piston 40 may be located on the second axis 92.

The piston 40 and the crank pin 51 may be connected to each other by connecting rod 46. The crank pin 51 may be inserted into one or a first end of the connecting rod 46, which may be rotatably connected to the crank pin 51. A rotational axis of one end of the connecting rod 46 with respect to the crank pin 51 may be parallel with the first axis 91.

The other or a second end of the connecting rod 46 may be rotatably fastened to the piston 40 by a piston pin 42. A rotational axis of the other end of the connecting rod 46 with respect to the piston pin 42 may be also parallel with the first axis 91.

By operation of motors 21 and 52, the rotational shaft 50 may rotate with respect to the first axis 91. Then, the crank pin 51 may circle (revolve) around the first axis 91, and the piston 40 connected to the crank pin 51 via the connecting rod 46 may reciprocate along the second axis 92.

A lubricating oil supplying portion 60 may be installed at a lower portion of the rotational shaft 50. Lubricating oil may be stored in a lower portion of an inner space of the housing 10. The lubricating oil supplying portion 60 may be submerged in the lubricating oil. The lubricating oil supplying portion 60 may be provided with a fixed portion 61 that maintains a fixed state without being rotated and a rotational portion 62 that rotates together with the rotational shaft 50. The fixed portion 61 may be fixed to the stator 21, and/or the lower frame 24, for example. Rotation of the rotational portion 62 relative to the fixed portion 61 may pump the lubricating oil upward.

Figure 2:
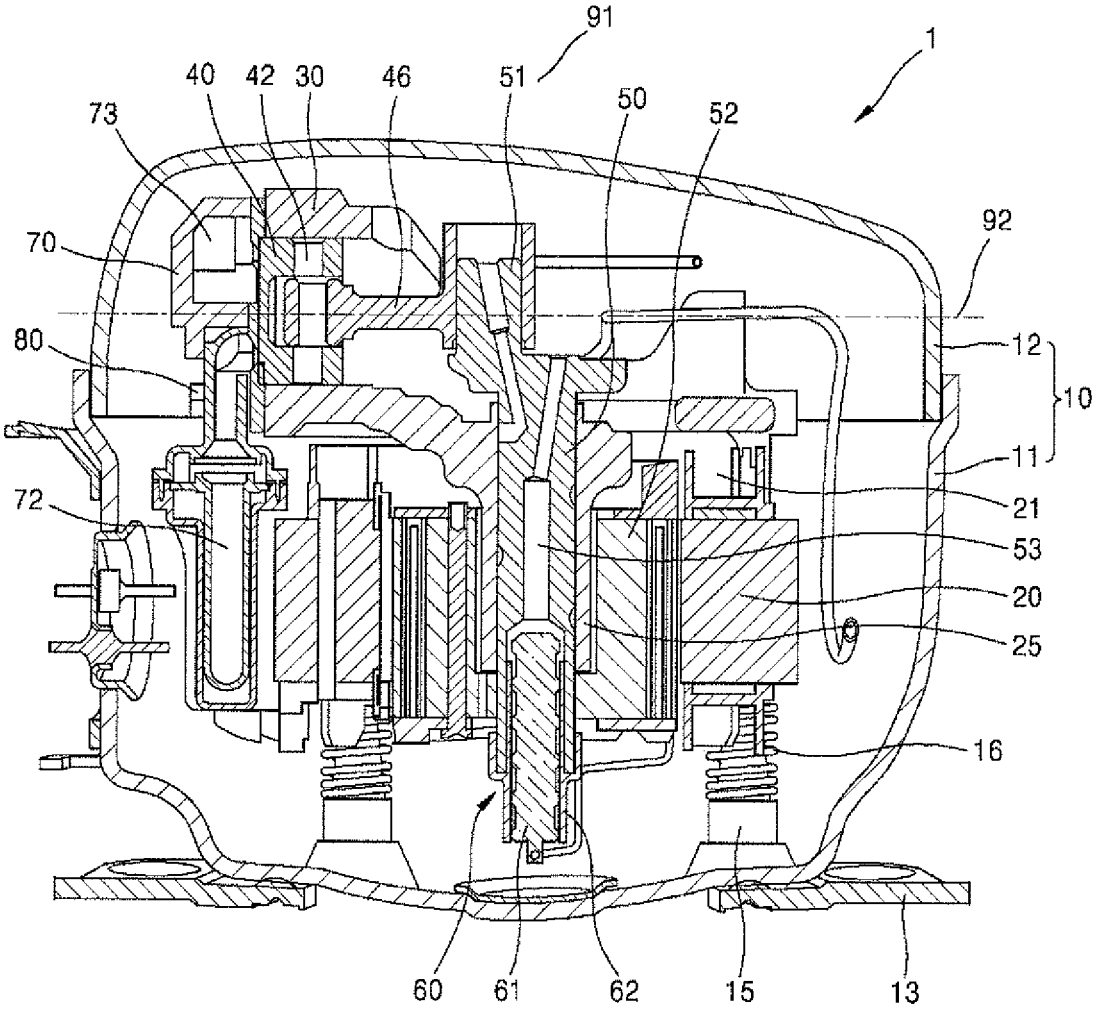
FIG. 2 is a side sectional view of the compressor of FIG. 1.

FIG. 2 shows a structure in which the fixed portion 61 having a spiral protruding portion formed on an outer circumferential surface thereof is fixed to frame 20, and the rotational portion 62 that surrounds the fixed portion 61 is fixed to the rotational shaft 50 to rotate together with the rotational shaft 50. When the rotational portion 62 rotates, lubricating oil may be supplied upward in a spiral direction along the protruding portion of the fixed portion 61 by the viscosity of the lubricating oil. On the other hand, FIG. 8 shows a trochoid pump type lubricating oil supplying portion 60.

The rotational shaft 50 may be provided with a hollow lubricating oil supply path 53. The lubricating oil supply path 53 may extend from a lower end of the rotational shaft 50 to a vicinity of a location where lubrication is required. Oil (lubricating oil) may be supplied to a gap portion or gap between the cylinder 30 and the piston 40, a connection portion between the crank pin 51 and the connecting rod 46, a vicinity of the piston pin 42 that is a connecting portion between the connecting rod 46 and the piston 40, and a supporting portion of the rotational shaft 50. The lubricating oil supplied to where lubricating oil is needed may flow down or fall back to a bottom of the housing 10 by gravity after lubricating a relevant portion.

Cylinder head 70 may be installed at an end of the cylinder 30 located far or at a distance from the first axis 91, so as to cover the bore. The cylinder head 70 may be provided with a suction chamber 72 and a discharge chamber 73 that each communicate with the bore of the cylinder 30.

At least one sealing member 32 may be compressed and interposed between the cylinder 30 and the cylinder head 70 to prevent fluid from leaking into a gap between the cylinder 30 and the cylinder head 70. Also, between the cylinder 30 and the cylinder head 70, there may be installed a check valve 33 including a check valve portion disposed at a portion which allows the suction chamber 72 and the bore of the cylinder to communicate with each other therethough and a check valve portion disposed at a portion which allows the discharge chamber 73 and the bore of the cylinder to communicate with each other therethough. The at least one sealing member 32 may be interposed between the cylinder 30, the check valve 33, and the cylinder head 70 to prevent leakage of fluid.

The check valve disposed at a portion where the suction chamber 72 and the bore of the cylinder communicate with each other may allow fluid in the suction chamber 72 to flow toward the bore of the cylinder, and may block the fluid from flowing in an opposite direction thereof. The check valve disposed at a portion where the discharge chamber 73 and the bore of the cylinder communicate with each other may allow fluid in the bore of the cylinder to flow toward the discharge chamber 73, and may block the fluid in an opposite direction thereof.

Thus, when the piston 40 moves in a direction away from the cylinder head 70 as the rotational shaft 50 rotates by the motor, the fluid in the suction chamber 72 may flow into the bore of the cylinder. When the piston 40 moves toward the cylinder head 70, the fluid in the bore of the cylinder may be compressed and discharged to the discharge chamber 73.

A combined structure of upper and lower frames and the cylinder will be described with reference to FIGS. 3 to 8.

The lower frame 24 may be manufactured by processing a "T"-shaped sheet metal. A central portion of the lower frame 24 may be provided with the lower rotational supporting portion 245 through which the rotational shaft 50 passes. The lower rotational supporting portion 245 may be provided with the bearing 26. The rotational shaft 50 may be rotatably supported by the lower rotational supporting portion 245 through the bearing 26. The bearing 26 may be a thrust bearing. An inner circumferential surface of the lower rotational supporting portion 245 may rotatably support an outer circumferential surface of the rotational shaft 50.

An inner diameter portion or diameter of the lower rotational supporting portion 245, which is manufactured out of sheet metal, may be subjected to drawing processing to have a ring or donut shape that is convex downward. Accordingly, the inner diameter portion of the lower rotational supporting portion 245 may have a sufficient length in the vertical direction even when it is manufactured out of sheet metal. Further, a downward convex geometric shape may improve rigidity of a relevant portion. In addition, the bearing 26 may be received and supported in a space with a groove shape provided by such a shape.

In the lower frame 24, a lower cylinder supporting portion 247 to align and support the cylinder 30 may be provided at one side of the lower rotational supporting portion 245. The cylinder lower supporting portion 247 may be processed into a shape to surround a lower portion of the outer diameter portion of the cylinder 30 which is laid down.

Figure 4:
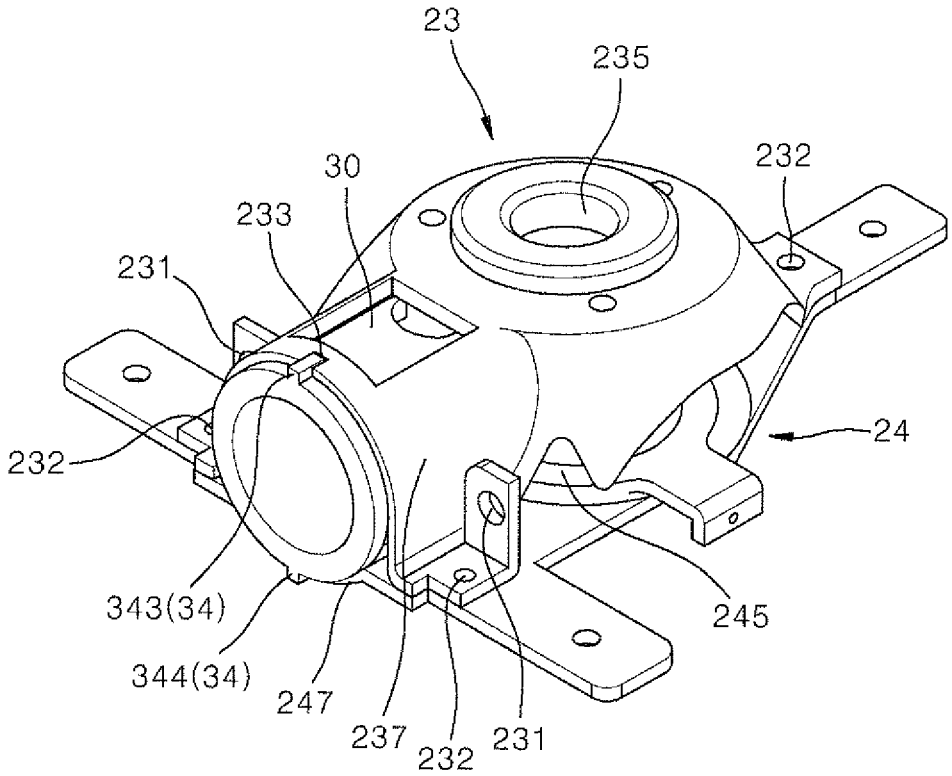
FIG. 4 is a top perspective view showing a combined state of a lower frame, an upper frame, and a cylinder of FIG. 3.
Figure 5:
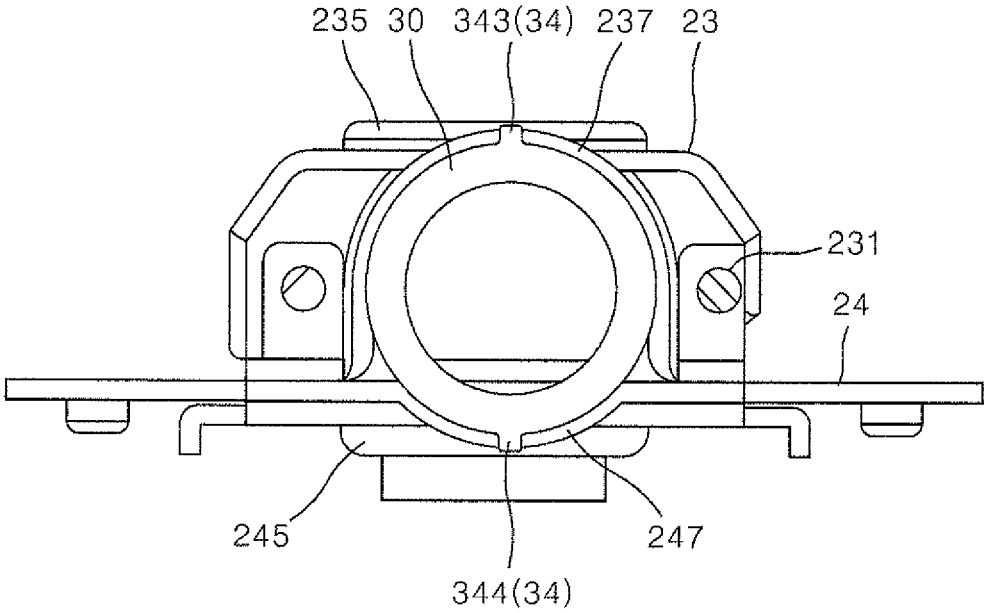
FIG. 5 is a front view of FIG. 4.
Figure 6:
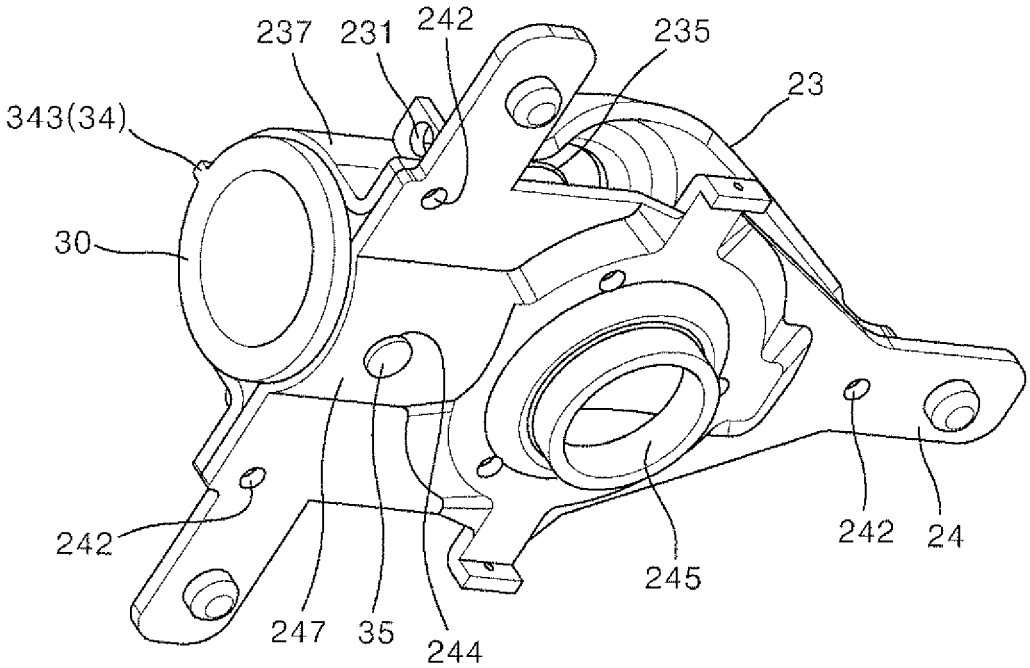
FIG. 6 is a bottom perspective view of FIG. 4.

Referring to FIGS. 4 and 5, a lower stopper boss 344 that extends outward in a radial direction of the cylinder 30 may be formed at a lower fore-end of the outer diameter portion of the cylinder 30. The lower stopper boss 344 may extend along a direction of the second axis 92.

A lower fore-end of the cylinder lower supporting portion 247 may be provided with a catch groove 243 to receive at least a portion of the lower stopper boss 344 in a direction of the second axis 92. The cylinder 30 may be laid down on the cylinder lower supporting portion 247, and the lower stopper boss 344 of the cylinder 30 may be aligned with the catch groove 243 to be caught thereby.

Therefore, the cylinder lower supporting portion 247 may regulate a downward location of the cylinder 30. The catch groove 243 may restrain the cylinder 30 from rotating with respect to the second axis 92 and moving in a direction toward the lower rotational supporting portion 245 along a longitudinal direction of the second axis 92.

FIG. 7 shows a modification of the lower stopper boss 344 shown in FIGS. 4 and 5. First, an alignment boss 323 that extends outward in a radial direction of the cylinder 30 is provided in a vicinity of a center of a lower portion of the outer diameter portion of the cylinder 30. Although it is shown that the alignment boss 323 has a circular sectional shape, a shape thereof is not limited thereto.

A temporary fastening groove 244 having a shape corresponding to the alignment boss 323 to accommodate the alignment boss 323 may be provided at a portion of the cylinder lower supporting portion 247 corresponding to the alignment boss 323. The catch groove 243 and the lower stopper boss 344 to restrict the cylinder from moving in any one direction of the second axis 92 may differ from the alignment boss 323 and the temporary fastening groove 244 to restrict the cylinder from moving in bilateral directions of the second axis 92 in terms of a structure.

Opposite ends of the cylinder lower supporting portion 247 each may be provided with an extending portion which extends laterally, and the extending portion may be provided with a vertical fastening hole 242. In the lower frame 24, the other side of the lower rotational supporting portion 245 may be also provided with the extending portion, and the vertical fastening hole 242 also may be provided therein.

That is, a vertical fastening hole 242 may be formed at each of three locations close to an edge of the "T"-shaped lower frame 24. This configuration is intended to be aligned with a vertical fastening hole 232 of the upper frame 23 to be described hereinafter, and to couple the two frames 23 and 24 by a fastening means, such as a bolt, for example, to each other.

The upper frame 23 also may be manufactured out of sheet metal.

The upper rotational supporting portion 235 to support an upper end of the rotational shaft 50 may be provided at a central portion of the upper frame 23. In the same manner as the lower rotational supporting portion described above, an inner diameter portion or diameter of the upper rotational supporting portion 235 also may be subjected to a drawing processing to have a shape of a ring or a donut that is convex upward. The upper rotational supporting portion 235 may be aligned with the lower rotational supporting portion 245 in the vertical direction.

The crank pin 51 of the rotational shaft 50 may be located in a space between the upper rotational supporting portion 235 and the lower rotational supporting portion 245. The upper rotational supporting portion 235 may support an upper end of the rotational shaft 50 provided above the crank pin 51. As the compressor operates, a load of the piston 40 may be transferred to the crank pin 51. In embodiments, the rotational shaft 50 may be supported at upper and lower opposite ends thereof on the basis of the crank pin 51, thereby firmly supporting the rotational shaft 50 even when the rotational shaft 50 is short.

A periphery of the upper rotational supporting portion 235 may be configured in a shape of an umbrella so as to cover a space in which the crank pin 51 and the connecting rod 46 move.

A cylinder upper supporting portion 237 to align and support the cylinder 30 may be provided at one or a first side of the upper rotational supporting portion 235. The cylinder upper supporting portion 237 may be processed to have a shape to cover an upper portion of the outer diameter portion of the cylinder 30 that is laid down. The cylinder upper supporting portion 237 and the cylinder lower supporting portion 247 may cooperate to surround an outer diameter circumference of the cylinder 30.

An upper stopper boss 343 that extends in a radial direction of the cylinder 30 may be formed at an upper fore-end of the outer diameter portion of the cylinder 30. The upper stopper boss 343 may be extended along a direction of the second axis 92.

A fore-end of the cylinder upper supporting portion 237 may be provided with a catch groove 233 to receive at least a portion of the upper stopper boss 343 in a direction of the second axis 92. In a state in which the cylinder 30 is aligned on the cylinder lower supporting portion 247, the cylinder upper supporting portion 237 may cover an upper portion of the cylinder 30. Accordingly, when the upper stopper boss 343 and the catch groove 233 are aligned with each other in the process of covering an upper portion of the cylinder 32 with the cylinder upper supporting portion 237, all of the cylinder lower supporting portion 247, the cylinder 30, and the cylinder upper supporting portion 237 may be aligned.

The cylinder upper supporting portion 237 may regulate an upper location of the cylinder 30. The catch groove 233 may restrain the cylinder 30 from rotating with respect to the second axis 92 and moving in a direction toward the lower rotational supporting portion 245 along a longitudinal direction of the second axis 92. The two cylinder supporting portions 237 and 247 may cooperate to restrain the cylinder 30 from rotating with respect to an axis parallel with the first axis 91 and rotating with respect to an axis perpendicular to both the first axis 91 and the second axis 92.

A lower end of the cylinder upper supporting portion 237 may extend down to an upper surface of the lower frame 24. The lower end of the cylinder upper supporting portion 237 may extend laterally, and the extending portion may face and contact the upper surface of the lower frame 24, and the vertical fastening hole 232 may be provided in the extending portion. The vertical fastening hole 232 may face the vertical fastening hole 242 of the lower frame 24. When the upper frame 23 and the lower frame 24 are fixed through the vertical fastening holes 232 and 242 at opposite sides of the upper supporting portion 237 and the lower supporting portion 247 of the cylinder, it is possible to firmly fix the frames 23 and 24 simultaneously while tightly fixing the cylinder 30.

Referring to FIG. 5, the cylinder upper supporting portion 237 may gradually widen to correspond to a shape of the outer diameter of the cylinder 30 as it extends toward a lower portion thereof from an upper portion thereof, and then may extend downward in the vertical direction after its widest point. When the upper frame 23 and the lower frame 24 are tightened by fastening bolts, for example, through the vertical fastening holes 232 and 242 at opposite sides of the upper supporting portion 237 and the lower supporting portion 247 of the cylinder 30, the cylinder 30 may be more firmly supported between the cylinder upper supporting portion 237 and the cylinder lower supporting portion 247 of the two frames.

The other side of the upper rotational supporting portion 235 also may be provided with an extending portion that extends obliquely downward. A portion where the extending portion is in contact with the upper surface of the lower frame 24 may be provided with the vertical fastening hole 232. The vertical fastening hole 232 may face the vertical fastening hole 242 located at the other side of the lower rotational supporting portion 245. Therefore, the upper rotational supporting portion 235 and the lower rotational supporting portion 245 may be fixed at a minimum of three points at proper locations in a circumferential direction with respect to the first axis 91, so as to firmly maintain a state in which the two rotational supporting portions 235 and 345 are aligned with each other.

Hereinafter, an assembling method of the cylinder 30 and the cylinder head 70 will be described with reference to FIGS. 3 to 8.

A bent portion that is bent upward may be provided at a rear end of the extending portion that extends ambilaterally from the cylinder upper supporting portion 237 of the upper frame 23. The bent portion may have a surface that faces frontward, and the nut hole 231 may be provided therein.

The cylinder head 70 may have a portion that faces the cylinder 30 and a portion that extends ambilaterally therefrom. A through hole 71 may be formed in a portion that extends ambilaterally from the cylinder head 70, and the through hole 71 may be aligned with and face the nut hole 231 provided in the bent portion of the upper frame 23.

An upper portion of a rear end of the cylinder head 70 may be provided with a catch groove 74 into which a portion of the front of the upper stopper boss 343 of the cylinder 30 may be inserted. Also, as shown in FIGS. 4 and 5, when the cylinder 30 is provided with the lower stopper boss 344, a lower portion of the rear end of the cylinder head 70 also may be provided with the catch groove 71.

The catch grooves 233 and 244 may be inserted and aligned at the rear of the stopper boss 34 of the cylinder 30. The cylinder head 70 may be inserted and aligned at the front of the stopper boss 34 of the cylinder 30. As a result, all of the frame 20, the cylinder 30, and the cylinder head 70 may be aligned.

The check valve 33 and the sealing members 32 may be interposed between the cylinder 30 and the cylinder head 70, and both the check valve 33 and the sealing members 32 need to be aligned. Therefore, the check valve 33 and the sealing members 32 also may be provided with alignment boss 323 and 333, respectively, at a location corresponding to the stopper boss 34.

Then, the alignment boss 323 and 333 of the check valve 33 and the sealing members 32 may be inserted into the catch groove 74 of the cylinder head 70, and subsequently stopper boss 34 of the cylinder 30 may be inserted, and thereby alignment may be precisely performed. For precise alignment of the aforementioned component elements, the stopper boss 34, the alignment boss 323 and 333, and the catch groove 74 may be provided at upper and lower portions.

In a state in which the cylinder head 70, the sealing member 32, the check valve 33, the other sealing member 32 and the cylinder 30 are aligned, the fastening bolt 80 may be fastened to the nut hole 231 of the upper frame 23 through the through hole 71 of the cylinder head 70. The nut hole 231 may have various structures in which an inner circumferential surface of the nut hole 231 is tapped, an additional nut is fixed to a rear of the nut hole 231 by means of welding, or a nut is disposed at the rear of the nut hole 231, for example.

Also, the upper frame 23 is not necessarily provided with the nut hole 231, but the lower frame 24 may have a bent portion, and a nut hole may be formed in the bent portion. That is, a shape of the nut hole is not limited to the shape shown in the drawings as long as the nut hole has a structure in which the cylinder head 70 is brought into close contact with the cylinder 30 so that the fastening bolt is indirectly fastened through the frame, for example, without being directly fastened to the cylinder.

According to such a fastening method, a fastening force of the fastening bolt may not affect the cylinder manufactured as a separate component from the frame to which the fastening bolt is fastened, so that the shape of the bore of the cylinder may not deformed. Therefore, a gap between the piston and the bore may not change after assembly.

Therefore, even when the gap between the piston and the bore is not set to be wide in a design step, it is possible to prevent the gap between the piston and the bore from being narrowed to such an extent that no oil film is formed after being assembled, thereby further ensuring wear reliability. In addition, as it is not necessary to set a gap between the piston and the bore to be wide, it is possible to reduce the gap between the piston and the bore to an optimum state, thereby minimizing an amount of fluid leaking between the bore and the piston, and further enhancing the compression efficiency of the compressor.

Figure 3:
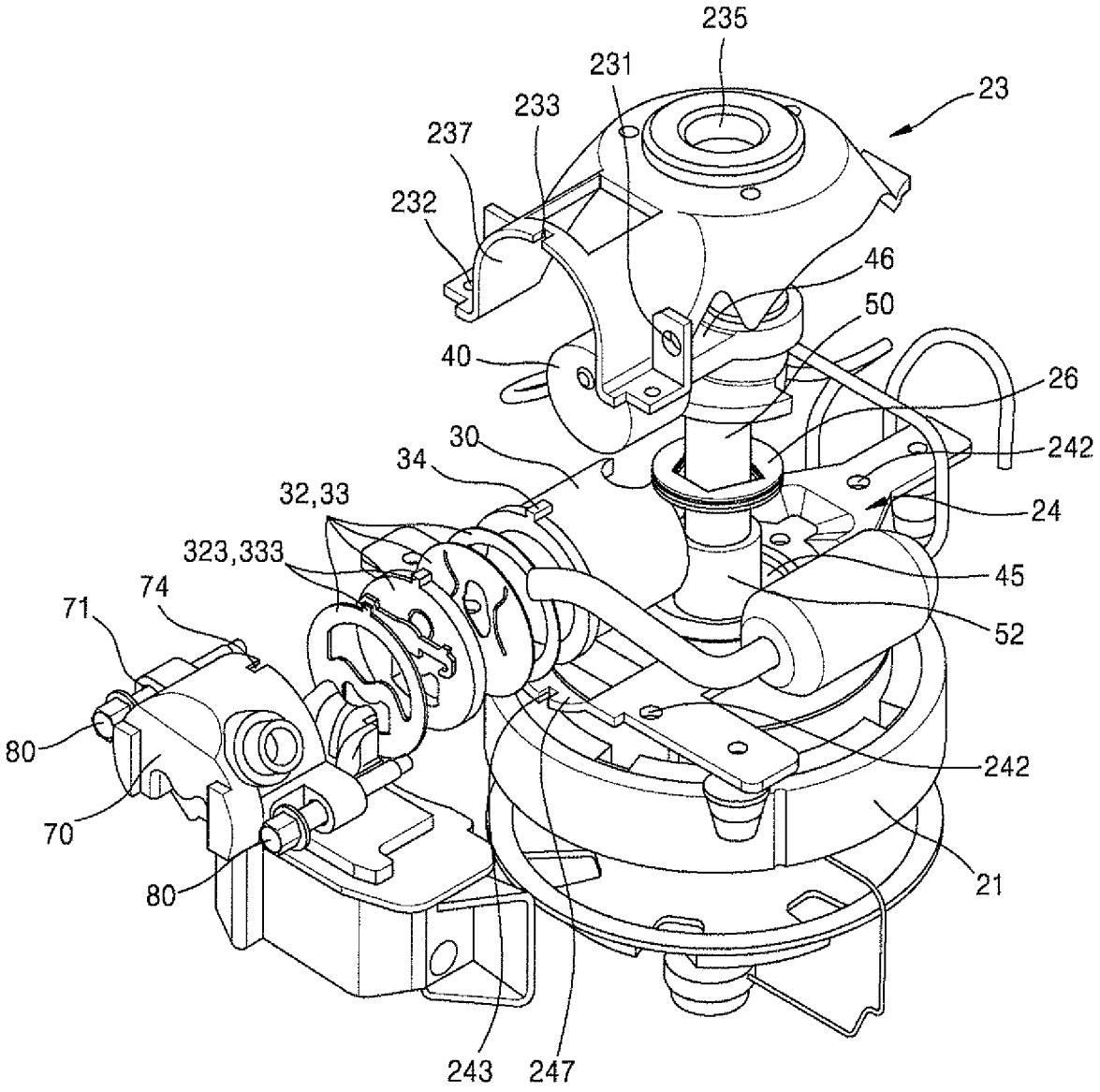
FIG. 3 is an exploded perspective view showing internal components of a reciprocating type compressor according to an embodiment.

Also, it is not necessary to manufacture the cylinder in a block shape as shown in FIG. 1. That is, it is enough that the cylinder is manufactured in a cylinder shape as shown in FIG. 3, thereby greatly reducing a weight and a volume of the cylinder.

Embodiments disclosed herein provide a compressor having a structure in which a rotational supporting portion to support a rotational shaft and a cylinder are manufactured as separate components, and a frame provided with the rotational supporting portion may align and firmly support the rotational shaft and the cylinder. Further, embodiments disclosed herein provide a compressor which may prevent deformation of a bore of the cylinder by allowing a cylinder head to be assembled into the cylinder through a frame that fixes the cylinder without being fixed directly to the cylinder. Furthermore, embodiments disclosed herein provide a compressor having a structure in which the frame that fixes the cylinder may support opposite ends of a crank pin of the rotational shaft, thereby greatly reducing a size and a weight of the compressor.

A compressor according to embodiments disclosed herein may include a rotational shaft to rotate with respect to a first axis, a cylinder installed at a location spaced apart from the first axis and provided with a bore that extends along a longitudinal direction of a second axis orthogonal to the first axis, and a frame to support the rotational shaft and the cylinder. The frame may include a lower frame provided with a lower rotational supporting portion to support the rotational shaft and a cylinder lower supporting portion with the cylinder mounted thereon to restrict a downward movement of the cylinder by supporting a lower portion of the cylinder, and an upper frame provided with a cylinder upper supporting portion that is fixed to the lower frame at an upper portion of the lower frame and mounted on an upper portion of the cylinder to restrict an upward movement of the cylinder by supporting the upper portion of the cylinder. The lower frame and the upper frame may restrain the cylinder from rotating with respect to an axis parallel with the first axis and rotating with respect to an axis perpendicular to both the first axis and the second axis.

A lower side of an outer diameter portion or diameter of the cylinder may be provided with a lower stopper boss that protrudes downward from the outer diameter portion of the cylinder, and an end of the cylinder lower supporting portion further from the lower rotational supporting portion may be provided with a catch groove into which the lower stopper boss may be inserted, so as to restrain the cylinder from rotating with respect to the second axis and moving in a direction toward the first axis along the second axis.

A lower side of the outer diameter portion of the cylinder may be provided with a temporary fastening boss that protrudes downward from the outer diameter portion of the cylinder, and the lower rotational supporting portion may be provided with a temporary fastening groove having a shape corresponding to the temporary fastening boss, so that the temporary fastening boss may be temporarily fastened to the temporary fastening groove so as to restrain the cylinder from rotating with respect to the second axis and moving in a longitudinal direction of the second axis.

An upper side of the outer diameter portion of the cylinder may be provided with an upper stopper boss that protrudes upward from the outer diameter portion of the cylinder, and an end of the cylinder upper supporting portion further from the first axis may be provided with a catch groove into which the upper stopper boss is inserted, so as to restrain the cylinder from rotating with respect to the second axis and moving in a direction toward the first axis along the second axis.

The compressor may further include a cylinder head coupled to an end of the cylinder far from the first axis, a plurality of through holes provided in the cylinder head, a plurality of nut holes provided in the frame and respectively formed at locations which face the through holes, and a fastening bolt that passes through the through hole to be coupled to the nut hole.

The nut hole may be provided in the upper frame or the lower frame. The nut hole may be provided in a bent portion of the frame.

The upper frame and the lower frame may be manufactured out of a metal plate by sheet metal forming. The upper frame may be provided with an upper rotational supporting portion to support the rotational shaft. The upper rotation supporting portion may be spaced apart above from the lower rotational supporting portion.

The compressor may further include a piston inserted into the bore to reciprocate along a longitudinal direction of a second axis perpendicular to the first axis, a crank pin eccentrically disposed with respect to a rotational center of the rotational shaft and parallel with the first axis, and a connecting rod having one or a first end rotatably coupled to the crank pin and the other or a second end rotatably coupled to the piston. The crank pin may be disposed between the upper rotational supporting portion and the lower rotational supporting portion.

An end of the cylinder head that faces the cylinder may be provided with a catch groove into which the stopper boss may be inserted.

At least one of a sealing member or a check valve may be interposed between the cylinder and the cylinder head. A portion of the sealing member or the check valve corresponding to the stopper boss may be provided with an alignment boss and, and the alignment boss and may be inserted into the catch groove.

An edge of the lower frame may be provided with a vertical fastening hole, and an edge of the upper frame may be provided with a vertical fastening hole. The vertical fastening holes and may be mutually aligned. The cylinder may be configured in a cylinder shape.

According to a compressor assembling method of embodiments disclosed herein, a frame to support a rotational supporting portion and a cylinder may be manufactured as separate components by sheet metal forming, and thereby the frame provided with the rotational supporting portion may align and firmly support a rotational shaft and the cylinder while reducing a weight of a product. Further, according to embodiments disclosed herein, it is possible to prevent deformation of a bore of the cylinder and reduce a volume of the cylinder by allowing a cylinder head to be assembled into the cylinder through a frame that fixes the cylinder without being fixed directly to the cylinder.

Furthermore, according to embodiments disclosed herein, it is possible to support the rotational shaft at opposite ends of a crank pin through the frame, thereby firmly supporting the rotational shaft. Also, it is possible to reduce a length of the rotational shaft, thereby greatly reducing a volume of the compressor.

Embodiments described with reference to illustrative drawings, but are not limited by the embodiments described herein and accompanying drawings. It should be apparent to those skilled in the art that various changes which are not exemplified herein but are still within the spirit and scope may be made. Further, it should be apparent that, although an effect from a configuration is not clearly described in the embodiments, any effect, which can be predicted from the corresponding configuration, is also to be acknowledged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a rotational shaft to rotate with respect to a first axis which is a vertical axis;

a cylinder installed at a location spaced apart from the first axis and provided with a bore that extends along a longitudinal direction of a second axis orthogonal to the first axis;

a cylinder head coupled to an end of the cylinder which is farthest from the first axis; and a frame to support the cylinder, wherein the frame comprises:

a lower frame provided with a cylinder lower support having the cylinder mounted thereon to restrict a downward movement of the cylinder by supporting a lower portion of the cylinder; and an upper frame provided with a cylinder upper support that is fixed to the lower frame at an upper portion of the lower frame and mounted on an upper portion of the cylinder to restrict an upward movement of the cylinder by supporting the upper portion of the cylinder, wherein the lower frame and the upper frame restrain the cylinder from rotating with respect to an axis parallel with the first axis, rotating with respect to an axis perpendicular to both the first axis and the second axis, and moving in a direction toward the first axis along the second axis, and wherein the compressor further comprises:

a plurality of through holes provided in the cylinder head;

a plurality of nut holes provided in the frame, the plurality of nut holes respectively formed at locations that face the through holes; and a plurality of fastening bolts that respectively passes through the plurality of through holes to be coupled respectively to the plurality of nut holes, wherein the upper frame and the lower frame are manufactured out of a metal plate by sheet metal forming.

2. The compressor of claim 1, wherein the plurality of nut holes are provided at a portion of the upper frame or the lower frame, the portion formed by being bent from the upper frame or the lower frame so that the portion is not parallel to another portion of the upper frame or the lower frame.

3. The compressor of claim 1, wherein the lower frame is provided with a lower rotational support to support the rotational shaft, wherein the upper frame is provided with an upper rotational support to support the rotational shaft, wherein the upper rotational support is spaced apart from an upper portion of the lower rotational support, wherein the compressor further comprises:

a piston inserted into the bore to reciprocate along the longitudinal direction of the second axis;

a crank pin eccentrically disposed with respect to the rotational center of the rotational shaft, the crank pin extending parallel with the first axis; and a connecting rod having a first end rotatably coupled to the crank pin and a second end rotatably coupled to the piston, and wherein the crank pin is disposed between the upper rotational support and the lower rotational support.

4. The compressor of claim 1, wherein a stopper boss that protrudes outward from an outer circumferential surface of the cylinder is provided at the outer circumferential surface of the cylinder, and wherein an end of at least one of the cylinder lower support or the cylinder upper support which is further from the first axis is provided with a catch groove into which the stopper boss is inserted so as to restrain the cylinder from rotating with respect to the second axis, and moving in a direction toward the first axis along the second axis.

5. The compressor of claim 4, wherein an end of the cylinder head that faces the cylinder is provided with a catch groove into which the stopper boss is inserted.

6. The compressor of claim 5, wherein at least one of a sealing member or a check valve is interposed between the cylinder and the cylinder head, wherein a portion of the sealing member or the check valve corresponding to the stopper boss is provided with an alignment boss, and wherein the alignment boss is inserted into the catch groove.

7. The compressor of claim 1, wherein an edge of the lower frame is provided with a vertical fastening hole, wherein an edge of the upper frame is provided with a vertical fastening hole, and wherein the vertical fastening holes are mutually aligned.

8. A compressor, comprising:

a rotational shaft that rotates with respect to a first axis;

a cylinder installed at a location spaced apart from the first axis and provided with a bore that extends along a longitudinal direction of a second axis orthogonal to the first axis; and a plurality of frames that supports the rotational shaft and the cylinder, wherein the plurality of frames comprises:

a plurality of rotational supports that supports the rotational shaft and a plurality of cylinder supports having the cylinder mounted thereon that restricts a vertical movement the cylinder, wherein the plurality of frames restrains the cylinder from rotating with respect to an axis parallel to the first axis and rotating with respect to an axis perpendicular to both the first axis and the second axis, wherein an outer circumferential surface of the cylinder is provided with a stopper boss that protrudes outward from the outer circumferential surface of the cylinder, and wherein an end of at least one of the cylinder supports which is further from the first axis is provided with a catch groove into which the stopper boss is inserted so as to restrain the cylinder from rotating with respect to the second axis and moving in a direction toward the first axis along the second axis.

9. The compressor of claim 8, wherein the plurality of frames is manufactured out of a metal plate by sheet metal forming.

10. The compressor of claim 8, wherein a lower side of an outer circumferential surface of the cylinder is provided with a temporary fastening boss that protrudes downward from the outer circumferential surface of the cylinder, and wherein one of the plurality of cylinder supports is provided with a temporary fastening groove having a shape corresponding to the temporary fastening boss, so that the temporary fastening boss is temporarily fastened to the temporary fastening groove so as to restrain the cylinder from rotating with respect to the second axis and moving in the longitudinal direction of the second axis.

11. The compressor of claim 8, wherein the plurality of rotational supports is spaced apart from each other, wherein the compressor further comprises:

a piston inserted into the bore to reciprocate along the longitudinal direction of a second axis orthogonal to the first axis;

a crank pin eccentrically disposed with respect to a rotational center of the rotational shaft, the crank pin extending parallel to the first axis; and a connecting rod having a first end rotatably coupled to the crank pin and a second end rotatably coupled to the piston, and wherein the crank pin is disposed between the plurality of rotational supports.

12. The compressor of claim 8, wherein a cylinder head is coupled to an end of the cylinder which is farthest from the first axis, and wherein an end of the cylinder head that faces the cylinder is provided with a catch groove into which the stopper boss is inserted.

13. The compressor of claim 12, wherein at least one of a sealing member or a check valve is interposed between the cylinder and the cylinder head, wherein a portion of the sealing member or the check valve corresponding to the stopper boss is provided with an alignment boss, and wherein the alignment boss is inserted into the catch groove.

14. The compressor of claim 8, wherein the first axis is a vertical axis, and wherein the plurality of frames comprises:

a lower frame provided with a lower rotational support that supports the rotational shaft and a cylinder lower support having the cylinder mounted thereon to restrict a downward movement of the cylinder by supporting a lower portion of the cylinder; and an upper frame fixed to the lower frame at an upper portion of the lower frame, provided with a cylinder upper support mounted on an upper portion of the cylinder to restrict an upward movement of the cylinder by supporting the upper portion of the cylinder.

15. The compressor of claim 14, wherein an edge of the lower frame is provided with a vertical fastening hole, wherein an edge of the upper frame is provided with a vertical fastening hole, and wherein the vertical fastening holes are mutually aligned.

16. A compressor, comprising:

a rotational shaft that rotates with respect to a first axis;

a cylinder installed at a location spaced apart from the first axis and provided with a bore that extends along a longitudinal direction of a second axis orthogonal to the first axis; and a plurality of frames that supports the rotational shaft and the cylinder, wherein the plurality of frames comprises:

a plurality of rotational supports that supports the rotational shaft and a plurality of cylinder supports having the cylinder mounted thereon that restricts a vertical movement the cylinder, wherein the plurality of frames restrains the cylinder from rotating with respect to an axis parallel to the first axis and rotating with respect to an axis perpendicular to both the first axis and the second axis, wherein a lower side of an outer circumferential surface of the cylinder is provided with a temporary fastening boss that protrudes downward from the outer circumferential surface of the cylinder, and wherein one of the plurality of cylinder supports is provided with a temporary fastening groove having a shape corresponding to the temporary fastening boss, so that the temporary fastening boss is temporarily fastened to the temporary fastening groove so as to restrain the cylinder from rotating with respect to the second axis and moving in the longitudinal direction of the second axis.

17. The compressor of claim 16, wherein the plurality of frames is manufactured out of a metal plate by sheet metal forming.

18. The compressor of claim 16, wherein the plurality of rotational supports is spaced apart from each other, wherein the compressor further comprises:

a piston inserted into the bore to reciprocate along the longitudinal direction of a second axis orthogonal to the first axis;

a crank pin eccentrically disposed with respect to a rotational center of the rotational shaft, the crank pin extending parallel to the first axis; and a connecting rod having a first end rotatably coupled to the crank pin and a second end rotatably coupled to the piston, and wherein the crank pin is disposed between the plurality of rotational supports.

19. The compressor of claim 16, wherein the first axis is a vertical axis, the plurality of frames comprises:

a lower frame provided with a lower rotational support that supports the rotational shaft and a cylinder lower support having the cylinder mounted thereon to restrict a downward movement of the cylinder by supporting a lower portion of the cylinder; and an upper frame fixed to the lower frame at an upper portion of the lower frame, provided with a cylinder upper support mounted on an upper portion of the cylinder to restrict an upward movement of the cylinder by supporting the upper portion of the cylinder.

20. The compressor of claim 16, wherein an edge of the lower frame is provided with a vertical fastening hole, wherein an edge of the upper frame is provided with a vertical fastening hole, and wherein the vertical fastening holes are mutually aligned.

* * * * *